United States Patent [19]
Green
[11] 4,317,568
[45] Mar. 2, 1982

[54] GOLF CLUB WITH REFERENCE PLUMB MARK

[76] Inventor: John R. Green, York, S.C.

[21] Appl. No.: 127,827

[22] Filed: Mar. 6, 1980

[51] Int. Cl.[3] ..... A63B 53/00
[52] U.S. Cl. ..... 273/163 A
[58] Field of Search ..... 273/32 R, 32 H, 77 R, 273/162 R, 162 B, 183 D, 183 E, 167 F, 193 R, 194 R, 163 R, 163 A, 164, 81 R, 81 B; D21/219; 33/295, 365, 391, 392, 398, 399, 293

[56] References Cited

U.S. PATENT DOCUMENTS

| | | | |
|---|---|---|---|
| 1,126,208 | 1/1915 | Hayford | 273/163 A |
| 1,169,667 | 1/1916 | Meguyer | 273/80 B |
| 1,239,356 | 9/1917 | Cochrane et al. | 273/80.9 |
| 2,846,228 | 8/1958 | Reach | 273/167 F X |
| 3,062,549 | 11/1962 | Duden | 273/167 F X |
| 3,182,401 | 5/1965 | Stevens | 273/162 B X |
| 3,186,092 | 6/1965 | Bertas | 273/163 A X |
| 3,242,582 | 3/1966 | Garrett | 273/32 H X |
| 3,693,978 | 9/1972 | East | 273/167 F |
| 3,848,874 | 11/1974 | Elkins | 273/81 B X |
| 4,114,886 | 9/1978 | Koch | 273/162 B |
| 4,212,467 | 7/1980 | Shiratori | 273/163 A |

FOREIGN PATENT DOCUMENTS

| | | | |
|---|---|---|---|
| 329486 | 5/1930 | United Kingdom | 273/81 R |

OTHER PUBLICATIONS

"Golf Digest", Sep. 1978, pp. 44–49.

*Primary Examiner*—Richard J. Apley
*Attorney, Agent, or Firm*—Richards, Shefte & Pinckney

[57] ABSTRACT

A golf putter provided with co-linear reference mark portions to facilitate use of the putter for accurate plumb lining, the mark portions being disposed at a predetermined location along the club shaft such that the lines and the longitudinal centerline of the shaft line in a vertical plane when the putter is held at the extending end of its handle for plumb lining, whereby the club shaft will appear as a vertical plumb line when viewed from a position from which the reference mark portions appear at substantially the circumferential center of the visible portion of the shaft.

5 Claims, 9 Drawing Figures

GOLF CLUB WITH REFERENCE PLUMB MARK

BACKGROUND OF THE INVENTION

The present invention relates to golf clubs and, more specifically, to golf clubs having reference marks thereon for various purposes.

It is generally recognized by golfers that putting is one of the most difficult skills to master in that it, unlike most other golf shots, requires not only appropriate skill in swinging the putter, but also requires the ability to anticipate the path a golf ball will take, after being struck, as it rolls across the undulating contour of the green. Since this undulating contour generally varies substantially from green to green, and from one point on a given green to another, the golfer is constantly faced with the problem of detecting or "reading" the particular contour of the green between the cup and the ball which is about to be putted, whereby the golfer can make appropriate adjustments in the force and direction of the putting stroke to compensate for the effect which the green contour will have on the path of the ball after it is struck. Accordingly, the ability of a golfer to accurately detect or "read" a given green contour will generally improve substantially the golfer's effectiveness in putting.

As is well known to engineers, architects and surveyors, a vertical reference line or "plumb" line is most helpful when viewing a landscape horizontally thereacross in enabling someone to accurately detect the contour of the landscape and to accurately assess the deviation thereof from horizontal. Thus, many golfers, realizing this, attempt to utilize one of their golf clubs, usually the putter, to strike a vertical plumb line with the club shaft thereof by dangling the club by its grip at arms's length for sighting past it across the green. However, since the club heads of virtually all golf clubs and putters manufactured and sold today are geometrically unsymmetrical and/or affixed to their club shafts in an offset manner, the weight of the club head of a conventional golf club is not evenly distributed with respect to its shaft, and therefore the golf club, when loosely dangled from the upper end thereof, will not assume a true vertical disposition. As a result, the dangling golf club will not present a consistent, vertical plumb line, and the vertical offset of the club shaft will be apparent from every perspective from which it is viewed by the golfer holding the club except the one perspective where, by change, the golfer happens to hold the golf club at the one position at which the vertical offset lies in a vertical plane that coincides with the golfer's line of sight. Because conventional golf clubs do not provide any reference indicator by which a golfer can determine when the golf club is being held at the aforesaid one position providing an effective plumb line, and because it is unlikely that a golfer will hold the golf club at such one position by chance, a golfer cannot rely upon the accuracy of the apparent plumb line presented by dangling a conventional golf club from its upper end or grip.

The subject of plumb lining as it relates to the art of putting a golf ball has been treated in several articles in golfing periodicals, one of which articles appears at pages 44–49 in the September, 1978, issue of Golf Digest and is entitled "Can plumb bobbing help you?" As is noted in the article, many professional golfers feel that plumb lining of putts is merely a psychological aid to golfers while others are convinced it is a worthless exercise. The author of the article attributes such attitudes to the fact that few, if any, golfers properly practice plumb lining, and therefore he endeavors to instruct golfers in the proper technique. Although it is correctly noted that it is vital that the club be held properly to establish a true vertical plumb line, the author's observation that the head of the putter must extend either directly toward or away from the golfer when plumb lining is somewhat incorrect in that it fails to consider fully the hereinabove-mentioned fact that many club heads are not geometrically symmetrical. Since each differently configured and constructed putter club head will have its own center of gravity different from that of other club heads, each type of putter or other club must be held for plumb lining in an orientation peculiarly unique to that particular type of putter and different from other putters in order for its club shaft to appear to strike a true vertical plumb line. In view of these facts, it is quite understandable why plumb lining is so widely practiced incorrectly and its effectiveness is doubted by so many golfers.

Various devices have been proposed for attachment to the shaft of a conventional golf putter for the purpose of providing the golfer with a horizontal reference line when the golfer orients the club shaft vertically. Examples of such devices are disclosed in U.S. Pat. No. 3,182,401 to W. E. Stevens and U.S. Pat. No. 3,186,092 to C. S. Bertas. Unfortunately, such devices have not been accepted well by golfers at least partially due to the fact that the accuracy of the horizontal line provided is dependent entirely upon the accuracy of the verticality of the shaft of the golf club with which they are used, which, as explained above, is seldom correctly accomplished by golfers. In recognition of the inherent difficulty in utilizing a conventional golf club to strike a plumb line with the shaft thereof, various golf putter modifications have been proposed to better enable a golfer to utilize the putter for plumb lining. Thus, in U.S. Pat. No. 3,242,582 to C. L. Garrett, the provision of a small, pendulum-type, plumb line indicator slidably disposed in a recess in the end of the gripping handle of a conventional golf putter is disclosed for enabling a golfer to accurately determine a plumb line by withdrawing the indicator from its recess and holding the putter by the indicator in the above-described plumb lining manner. In U.S. Pat. No. 4,114,886 to Koch, a golf putter is disclosed having a geometrically symmetrically shaped and weighted putter head and having a plumb bob contained within the putter handle so that, when the club is held by the plumb bob in plumb lining manner, the club shaft will strike a vertical plumb line regardless of the orientation of the club circumferentially around its shaft with respect to the golfer. Although putters modified according to these inventions may enable a golfer to accurately determine verticality with consistency, putters manufactured according to such inventions will necessarily be more expensive than a comparable conventional putter due to the provision of a special plumbing arrangement within its handle. Moreover, the necessarily unusual configuration of the club head of the latter-mentioned putter is greatly different from that of most putters and thereby necessarily limits the acceptability of the putter.

In contrast to the above devices and in recognition of the fact that the shaft of any golf club or putter will extend in an offset but generally vertical disposition unique to that club or putter when held in the above-described plumb lining manner so as to appear to strike a vertical plumb line when such vertical offset lies in a plane coinciding with the golfer's line of sight, the present invention provides a manner of marking a golf club at a particular location along the shaft thereof to identify the perspective from which the shaft must be viewed when held in plumb lining manner for it to present a vertical plumb line, which manner of marking may be utilized with any golf club or putter.

SUMMARY OF THE INVENTION

Briefly described, the present invention provides an improvement in golf clubs of the type having a club head for striking a golf ball and a club shaft extending from the club head with the weight of the club head being unequally distributed about the longitudinal center line of the club shaft. The improvement comprises a reference mark disposed on the golf club at a particular predetermined location such that, when the club is held loosely at the extending end of the club shaft to hang downwardly in pendulum-like fashion, the reference mark will be in a vertical plane extending through the reference mark and the longitudinal center line of the club shaft. Thus, when the club is held loosely in such pendulum-like manner, the club shaft will present a vertical plumb line when viewed from a position from which the reference mark appears at substantially the circumferential center of the visible portion of the shaft.

In the preferred embodiment of the present invention, the reference mark is located on the club shaft and extends generally longitudinally along at least a portion thereof. Preferably, the golf club on which such mark is placed is a putter and the club shaft thereof is provided with a gripping handle at its extending end. The reference mark extends generally longitudinally along at least a portion of the club shaft, and may include three co-linear portions, one of the reference mark portions being disposed on the gripping handle of the shaft, a second portion being on the shaft itself, and a third portion being disposed adjacent the club head.

DESCRIPTION OF THE PREFERRED EMBODIMENT

Figure 1:
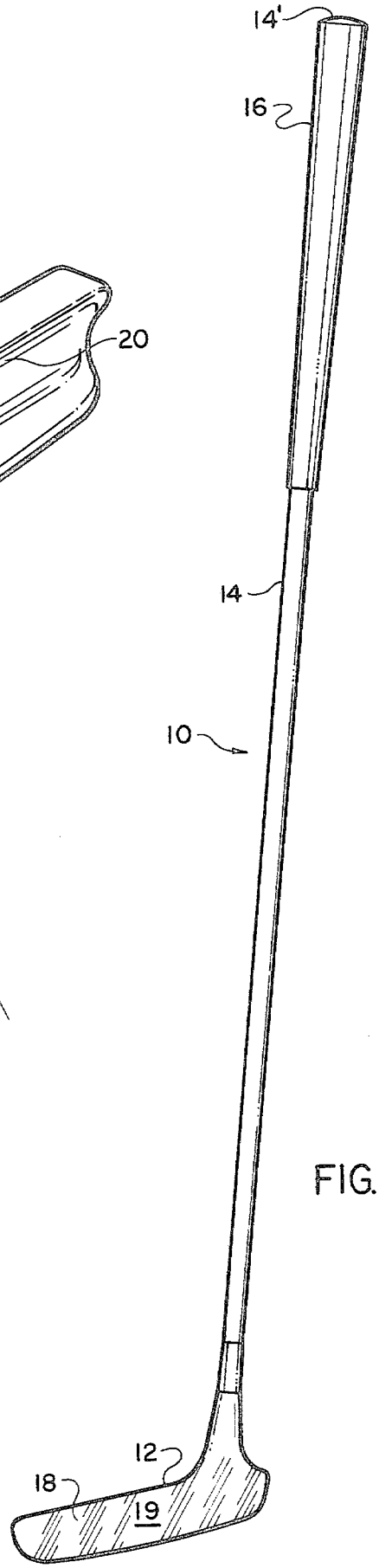
FIG. 1 is a perspective view of a golf putter of the type to which the present invention is applicable.
Figure 4:
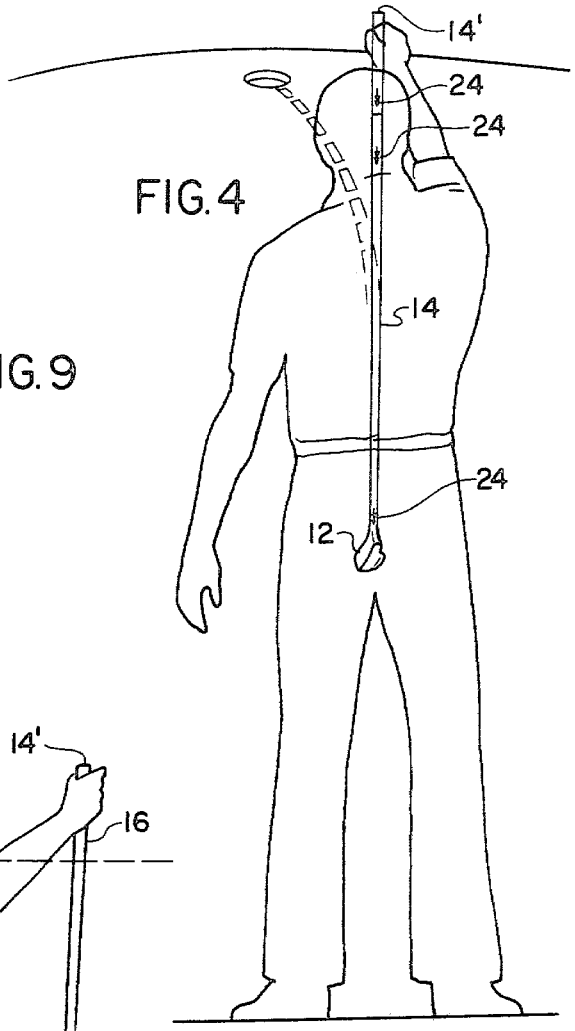
FIG. 4 is a perspective view of a golf green showing the utilization of the golf putter of FIG. 3 by a golfer for plumb lining a putt.
Figure 5:
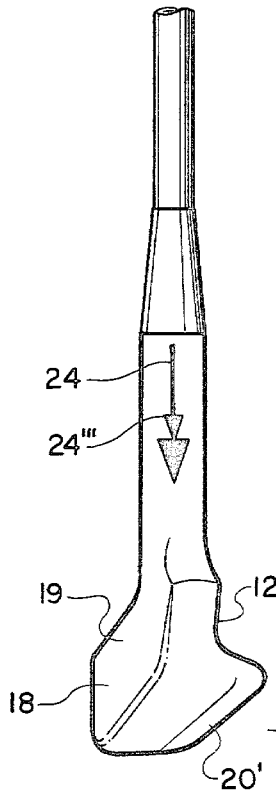
FIG. 5 is a side view of the golf putter and golfer of FIG. 4.
Figure 5:
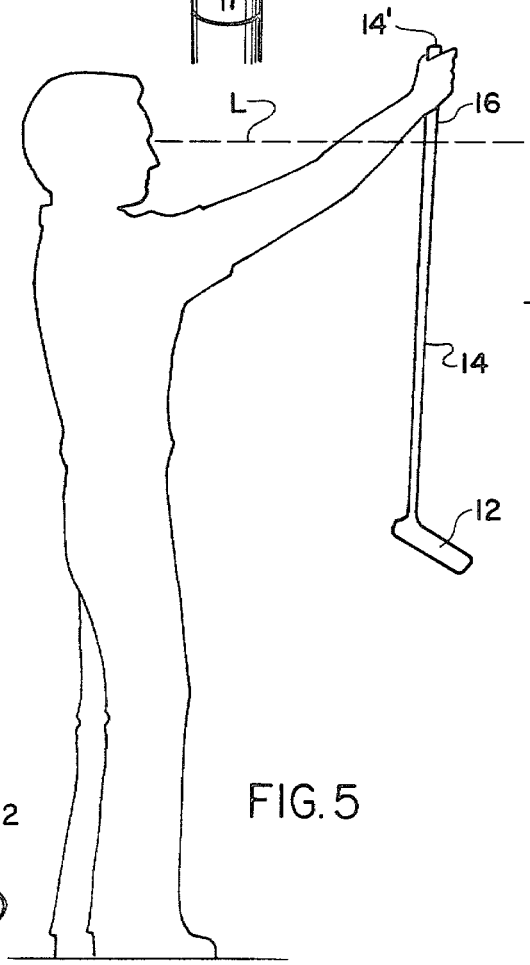

Referring now to the accompanying drawings, FIG. 1 illustrates a golf putter 10 of conventional construction including a club head 12 for striking a golf ball and a club shaft 14 extending from the club head 12 and having a gripping handle 16 at its extending end 14'. The basic procedure of utilizing a golf club, such as the putter shown in FIG. 1, to strike a vertical plumb line with the shaft thereof is well known and generally widely practiced, as has been discussed above. Generally, the procedure involves gripping the golf club by the golfer with his fingers loosely at the extending or upper end of its shaft and holding the golf club with such grip at arm's length in front of the golfer at a sufficient elevation so that the club depends from its upper end in pendulum-like manner directly in the golfer's line of sight L, as is illustrated in FIGS. 4 and 5. Inasmuch as the present invention is not directly concerned with the proper technique of plumb lining but rather with the facilitation of the striking of a true vertical plumb line when one practices the proper technique, and inasmuch as the proper technique is general public knowledge, the mechanics of plumb lining will not be treated in detail herein except insofar as they relate directly to the present invention. Reference is made to the above-referenced article concerning plumb lining for a detailed treatment of the subject.

As was also discussed above, the club heads of most golf clubs and putters manufactured and sold today have a geometrically unsymmetrical shape, and/or they are affixed in an offset relationship to the longitudinal center of their respective club shafts. As can be seen in the enlarged view of the typical club head 12 of the putter 10 illustrated in FIG. 2, the club head 12 comprises an elongated bar 18 having a generally smooth, flat surface 19 on one side thereof for striking a golf ball therewith and two outwardly extending ribs 20, 20' extending in spaced, generally parallel, relationship longitudinally along the other side of the bar 18 on opposite sides of a shallow intermediate channel 22, the rib 20' being substantially larger and having a substantially greater outward extension than the rib 20. The club head 12 is affixed to the club shaft 14 at one end of the elongated bar 18 with the bar 18 extending angularly outwardly from the shaft 14 in a disposition with respect to the shaft 14 such that, when the shaft 14 is gripped by the handle 16 for putting, the smooth surface 19 will be generally perpendicular and the larger rib 20' will be adjacent the putting surface of the golf green to provide a low center of gravity of the club head 12 to facilitate a more pendulum-like putting swing of the putter by the golfer.

Figure 6:
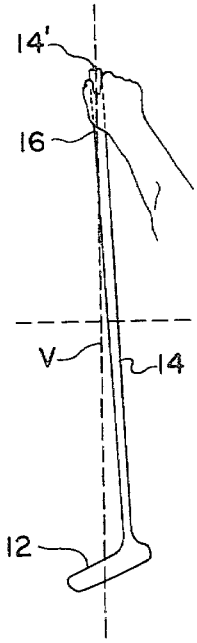
FIGS. 6–8 are detailed views similar to FIG. 4 taken from the same perspective thereas illustrating the relationship of the club shaft to the golf putter with respect to vertical when held in the manner of FIG. 4 with the putter head in different orientations about the circumference of the club shaft.
Figure 7:
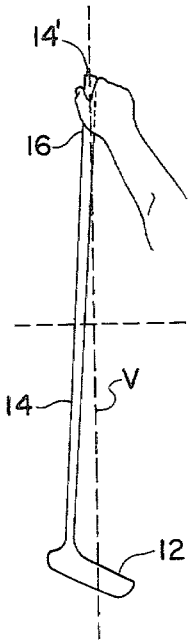
Figure 8:
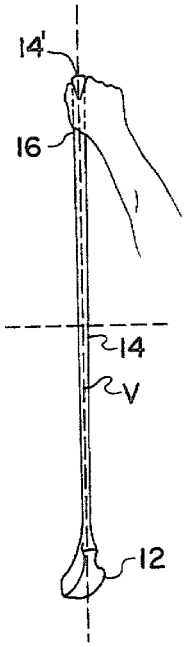

It is therefore apparent that the club head 12 is not geometrically symmetrically shaped and weighted, nor it is affixed to the club shaft 14 in a manner and at a location on the bar 18 such that the weight of the club head 12 is equally distributed about the shaft 14. As a result, the club shaft 14, when held in normal plumb lining manner as discussed above, will extend in a vertical plane, but the shaft 14 will deviate within that plane from a true vertical line. Thus, as is illustrated in FIGS. 6 and 7, the club shaft 14 will not present a true vertical plumb line, represented in FIGS. 6 and 7 by V, to the golfer when plumb lining is performed with the club head 12 extending outwardly to the golfer's right or left. It is only when plumb lining is performed, as illustrated in FIG. 8, with the putter 10 oriented so that the vertical plane in which its shaft lies coincides with the golfer's line of sight L, that the club shaft 14 will appear as a true vertical plumb line to the golfer. It is also evident from FIGS. 6 to 8 that the degree to which the club shaft 14 in FIGS. 6 and 7 deviates from vertical is relatively slight and would not be readily apparent to most golfers. However, as is well known to golfers, even slight deviations of this sort and slight miscalculations in judgment based thereon can result in mistakes of sufficient magnitude to make the difference between an accurate and an inaccurate putt.

In light of the above, the present invention provides a reference mark 24 (see FIG. 3) that extends generally longitudinally along at least a portion of the shaft 14. This reference mark 24 is disposed at a particular peripheral location on the shaft 14 to provide an accurate visual reference guide that enables the golfer to orient the golf club 10, during plumb lining, so that the shaft 14 of the golf club will appear as a true vertical plumb line when viewed from the perspective of the golfer holding the golf club. More specifically, the location of the reference mark 24 is selected on the basis of the weight distribution of the particular golf club to which it is applied, and this location is such that when the golfer orients the golf club to cause the reference mark 24 to be located at substantially the circumferential center of the portion of the shaft 14 that is visible to the golfer, the golf club will be disposed in relation to the golfer so that it lies in a vertical plane coinciding with the line of sight L of the golfer. At this orientation, the shaft 14 of the golf club and the reference mark 24 thereon will appear as a true vertical or plumb line, whereby the golfer is able to effectively utilize the dangling golf club for "plumbing" a green.

Figure 2:
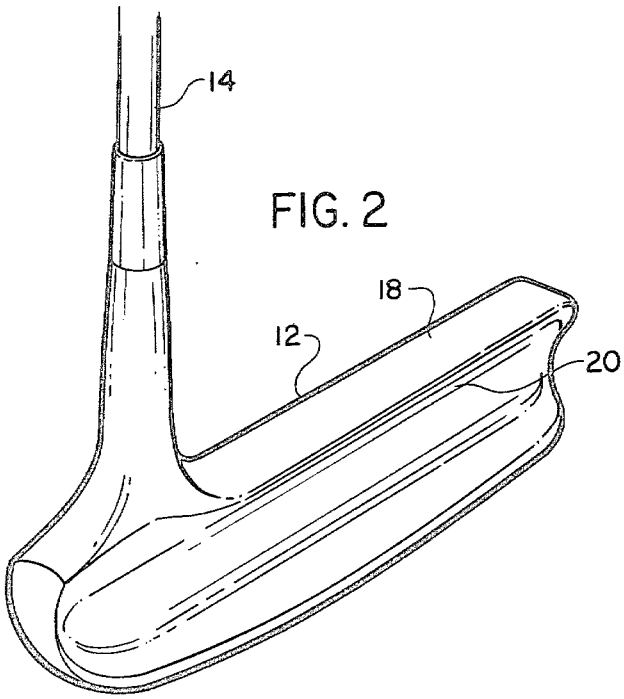
FIG. 2 is an enlarged perspective view of the putter head of the golf putter of FIG. 1.

It should be emphasized that this particular disposition of the reference mark 24 is correct for the above purpose only with regard to putters having a club head 12 of the configuration illustrated in FIG. 2 and affixed to the club shaft 14 in the manner and relationship illustrated in such figure. Thus, the manufacturer of golf clubs embodying the present invention will, for each different golf club, analyze the weight distribution of the golf club and determine the angle at which the golf club will hang when held at its upper end in pendulum-like fashion, and the manufacturer will then determine the particular location on the golf club at which the reference mark 24 should be added to assure that this reference mark will lie in a vertical plane extending through the reference mark 24 through the longitudinal centerline of the club shaft when the golf club is being held in the aforesaid pendulum-like fashion. Because the weight distribution will vary from one golf club to another, the location of the reference mark 24 on a given golf club will be different from that on differently constructed golf clubs. However, when the reference mark is properly located, a golfer using any such golf club as a plumb will always be able to orient the golf club, using the reference mark 24 as a guide, so that the shaft will appear as a vertical plumb line when the reference mark is disposed at substantially the circumferential center of the visible portion of the shaft as viewed by the golfer holding the golf club in pendulum-like fashion.

Figure 3:
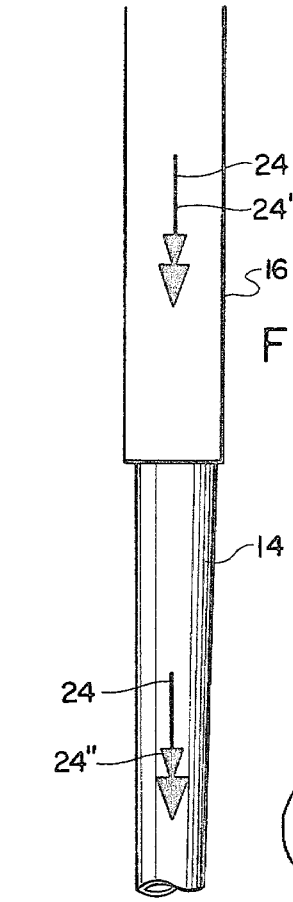
FIG. 3 is a rear elevational view of the golf putter of FIG. 1 with a reference mark provided on the shaft thereof in accordance with the present invention.

In one embodiment of the present invention shown in FIG. 3, the reference mark 24 comprises three portions 24', 24'', 24''' extending co-linearly and longitudinally along the shaft 14, the portion 24' being disposed on the gripping handle 16 at the lower end thereof, the portion 24'' being disposed on the shaft 14 a short distance below the handle 16 and the portion 24''' being disposed adjacent the club head 12. Each of the three portions 24', 24'', 24''' are preferably formed in the shape of a downwardly pointing arrow of the type utilized by surveyors and engineers to indicate a plumb line.

Figure 9:
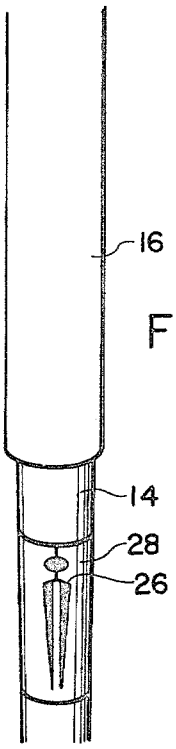
FIG. 9 is a rear elevational view of a portion of a putter showing an alternate use of a single reference mark on the shaft of the putter.

In another embodiment of the present invention shown in FIG. 9, the reference mark 26 is located only on the shaft 14 of the putter, preferably just below the gripping handle 16. In this embodiment, the reference mark 26 is printed on a label 28 that can be wrapped around the shaft 14 and secured thereto with adhesive or the like. The position of the reference mark 26 on the shaft 14 is determined in the manner set forth above, and the label 28 is secured to the shaft 14 so as to locate the reference mark 26 at its predetermined position.

The advantages accruing from the provision on a golf putter or other club of a reference mark according to the present invention are believed clear. A golf club provided with such a reference mark may be accurately utilized by a golfer for plumb lining by simply holding it loosely by the extending end of the handle of its shaft at arm's length at a sufficient elevation so as to depend from its extending end in pendulum-like manner in his forward line of sight with the club shaft turned so that the plumb line reference mark thereon appears at substantially the circumferential center of the visible portion of the shaft. Inaccuracies which may result from deviation of the club shaft from vertical caused by a geometrically non-symmetrical club head or the offset nature of affixation of the club head to the shaft and from the failure or inability to accurately gauge and compensate for such deviation are substantially alleviated. Moreover, the present invention does not require the costly and often undesirable additional structure or the modification of golf club structure necessary with golf clubs of the type proposed heretofore and discussed above for facilitating accurate plumb lining. Instead, the present invention may be adapted at an insignificant cost to any conventional golf club of the type having a club head and a shaft extending therefrom.

Although the present invention has been described herein in relation to the preferred embodiment thereof, it is to be understood that modifications and variations may be resorted to without departing from the substance or scope of the present invention as those skilled in the art will readily understand. Therefore, although the present invention has been illustrated and described herein as embodied in a golf putter, it is understood that, inasmuch as substantially all conventional golf clubs are of the same basic construction having a club head and a club shaft and are therefore equally usable for plumb lining, the present invention is equally applicable to and may be readily embodied in any conventional golf club of such general construction. Such modifications and variations are within the scope of the present invention, which is intended to be limited only by the appended claims and equivalents thereof.

I claim:

1. In a golf club of the type having a club head for striking a golf ball and a club shaft extending from said club head with the weight of said club head being unequally distributed about the longitudinal centerline of said shaft whereby, when the golf club is held loosely at the extending end of its shaft at a sufficient elevation so as to depend in pendulum-like manner, the longitudinal centerline of said shaft extends in only a single vertical plane, the improvement comprising a substantially linear reference mark positioned on said shaft and extending generally longitudinally along at least a portion thereof at a particular and predetermined unique location as determined by the weight distribution of said club head, said reference mark being positioned on the outer circumferential surface of said shaft coplanar with said longitudinal centerline of said shaft so as to extend in said vertical plane when the golf club is held in said pendulum-like manner, such that said club shaft will appear as a vertical plumb line only when viewed along a line of sight intersecting said reference mark and from a position from which said reference mark is located at substantially the circumferential center of the visible portion of the shaft.

2. The improvement of claim 1 and characterized further in that said golf club is a putter.

3. The improvement of claim 1 and characterized further in that said reference mark includes two separated portions extending co-linearly longitudinally along said club shaft.

4. The improvement of claim 3 and characterized further in that said club shaft includes a gripping handle at its extending end, one said reference mark portion being disposed on said gripping handle.

5. The improvement of claim 4 and characterized further in that said reference mark includes a third portion adjacent said club head and co-linear with said two reference mark portions on said club shaft.

* * * * *